US010907600B1

(12) United States Patent
Uckermark

(10) Patent No.: US 10,907,600 B1
(45) Date of Patent: Feb. 2, 2021

(54) FUEL PUMP AND OUTLET VALVE SEAT THEREOF

(71) Applicant: DELPHI TECHNOLOGIES IP LIMITED, St. Michael (BB)

(72) Inventor: Chad E. Uckermark, Warwick, NY (US)

(73) Assignee: DELPHI TECHNOLOGIES IP LIMITED

( * ) Notice: Subject to any disclaimer, the term of this patent is extended or adjusted under 35 U.S.C. 154(b) by 0 days.

(21) Appl. No.: 16/715,696

(22) Filed: Dec. 16, 2019

(51) Int. Cl.

| | |
|---|---|
| ***F02M 59/46*** | (2006.01) |
| ***F02M 63/00*** | (2006.01) |
| *F02M 59/36* | (2006.01) |
| *F02M 59/10* | (2006.01) |
| *F02M 63/02* | (2006.01) |

(52) U.S. Cl.
CPC ..... *F02M 59/462* (2013.01); *F02M 63/005* (2013.01); *F02M 59/102* (2013.01); *F02M 59/366* (2013.01); *F02M 63/0054* (2013.01); *F02M 63/0225* (2013.01); *F02M 2200/315* (2013.01)

(58) Field of Classification Search
CPC .. F02M 59/462; F02M 59/366; F02M 59/102; F02M 63/005; F02M 63/0225; F02M 63/0054; F02M 2200/315
USPC ..... 123/446, 457, 458, 459, 510, 511
See application file for complete search history.

(56) References Cited

U.S. PATENT DOCUMENTS

| | | | | |
|---|---|---|---|---|
| 7,124,738 | B2 | 10/2006 | Usui et al. | |
| 7,401,594 | B2 | 7/2008 | Usui et al. | |
| 7,707,996 | B2 | 5/2010 | Yamada et al. | |
| 2010/0242922 | A1 | 9/2010 | Mancini et al. | |
| 2020/0102924 | A1* | 4/2020 | Perry | F02M 63/0078 |
| 2020/0263646 | A1* | 8/2020 | Perry | F02M 59/361 |

* cited by examiner

*Primary Examiner* — Hai H Huynh
(74) *Attorney, Agent, or Firm* — Joshua M. Haines

(57) ABSTRACT

A fuel pump includes a fuel pump housing with a pumping chamber and an outlet valve bore extending along an outlet valve bore axis; a pumping plunger which reciprocates within a plunger bore along a plunger bore axis which is traverse to the outlet valve bore axis; and an outlet valve assembly. The outlet valve assembly includes an outlet valve seat with an outlet flow passage, wherein a first portion of the outlet valve seat is aligned with the pumping plunger in a direction parallel to the plunger bore axis and wherein a second portion of the outlet valve seat is not aligned with the pumping plunger in a direction parallel to the plunger bore axis and an outlet valve member which is moveable between an unseated position which provides fluid communication through the outlet flow passage and a seated position which prevents fluid communication through the outlet flow passage.

13 Claims, 8 Drawing Sheets

FUEL PUMP AND OUTLET VALVE SEAT THEREOF

TECHNICAL FIELD OF INVENTION

The present disclosure relates a fuel pump which supplies fuel to an internal combustion engine, and more particularly to such a fuel pump which includes a pumping plunger which reciprocates in a pumping chamber, and even more particularly to such a fuel pump which includes an outlet valve seat which extends into the pumping chamber and has a slot which receives the pumping plunger.

BACKGROUND OF INVENTION

Fuel systems in modern internal combustion engines fueled by gasoline, particularly for use in the automotive market, employ gasoline direct injection (GDi) where fuel injectors are provided which inject fuel directly into combustion chambers of the internal combustion engine. In such systems employing GDi, fuel from a fuel tank is supplied under relatively low pressure by a low-pressure fuel pump which is typically an electric fuel pump located within the fuel tank. The low-pressure fuel pump supplies the fuel to a high-pressure fuel pump which typically includes a pumping plunger which is reciprocated by a camshaft of the internal combustion engine. Reciprocation of the pumping plunger further pressurizes the fuel in order to be supplied to fuel injectors which inject the fuel directly into the combustion chambers of the internal combustion engine. During operation, the internal combustion is subject to varying demands for output torque. In order to accommodate the varying output torque demands, the mass of fuel delivered by each stroke of the pumping plunger must also be varied. One strategy to vary the delivery of fuel by the high-pressure fuel pump is to use a digital inlet valve which allows a full charge of fuel to enter the pumping chamber during each intake stroke, however, the digital inlet valve may be allowed to remain open during a portion of a compression stroke of the pumping plunger to allow some fuel to spill back toward the source. When the digital inlet valve is closed during the remainder of the compression stroke, the fuel is pressurized and the pressurized fuel is supplied to the fuel injectors. Examples of such an arrangement are disclosed in U.S. Pat. No. 7,401,594 to Usui et al. and in U.S. Pat. No. 7,707,996 to Yamada et al. Prior art inlet valves such as those disclosed by Usui et al. and Yamada et al. suffer from the shortfall of the inlet valve being retained within a housing of the high-pressure fuel pump by a secondary means such as one or more of interference fit, threaded connection, welding, and threaded fasteners. Not only do these secondary means increase cost and complexity, but robustness of the connection may be reduced. Consequently, it may be desirable to have a seat of the inlet valve supported by a shoulder in the housing. In order to accommodate assembly of the seat through the pumping chamber, it may be necessary to enlarge the sized of the pumping chamber. However, enlarging the pumping chamber to accommodate insertion of the seat creates a pumping chamber that has a volume that is greater than necessary, and as a result, an excessive dead volume is created, i.e. the volume of the pumping chamber is significantly greater in volume than the pumping plunger is able to pump in a stroke. This excessive dead volume leads to decreased efficiency.

What is needed is a fuel pump and inlet valve which minimizes or eliminates one or more of the shortcomings as set forth above.

SUMMARY OF THE INVENTION

Briefly described, a fuel pump includes a fuel pump housing with a pumping chamber defined therein, the fuel pump housing having an outlet valve bore, the outlet valve bore extending along, and centered about, an outlet valve bore axis; a pumping plunger which reciprocates within a plunger bore along a plunger bore axis which is traverse to the outlet valve bore axis such that an intake stroke of the pumping plunger increases volume of the pumping chamber and a compression stroke of the pumping plunger decreases volume of the pumping chamber; and an outlet valve assembly. The outlet valve assembly includes an outlet valve seat with an outlet valve seat flow passage extending therethrough, wherein a first portion of the outlet valve seat is aligned with the pumping plunger in a direction parallel to the plunger bore axis and wherein a second portion of the outlet valve seat is not aligned with the pumping plunger in a direction parallel to the plunger bore axis; and an outlet valve member which is moveable between 1) an unseated position which provides fluid communication through the outlet valve seat flow passage and 2) a seated position which prevents fluid communication through the outlet valve seat flow passage. The fuel pump with outlet valve seat described herein minimizes the dead volume of the pumping chamber, thereby maximizing efficiency while still allowing installation of an inlet valve seat through the pumping chamber.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
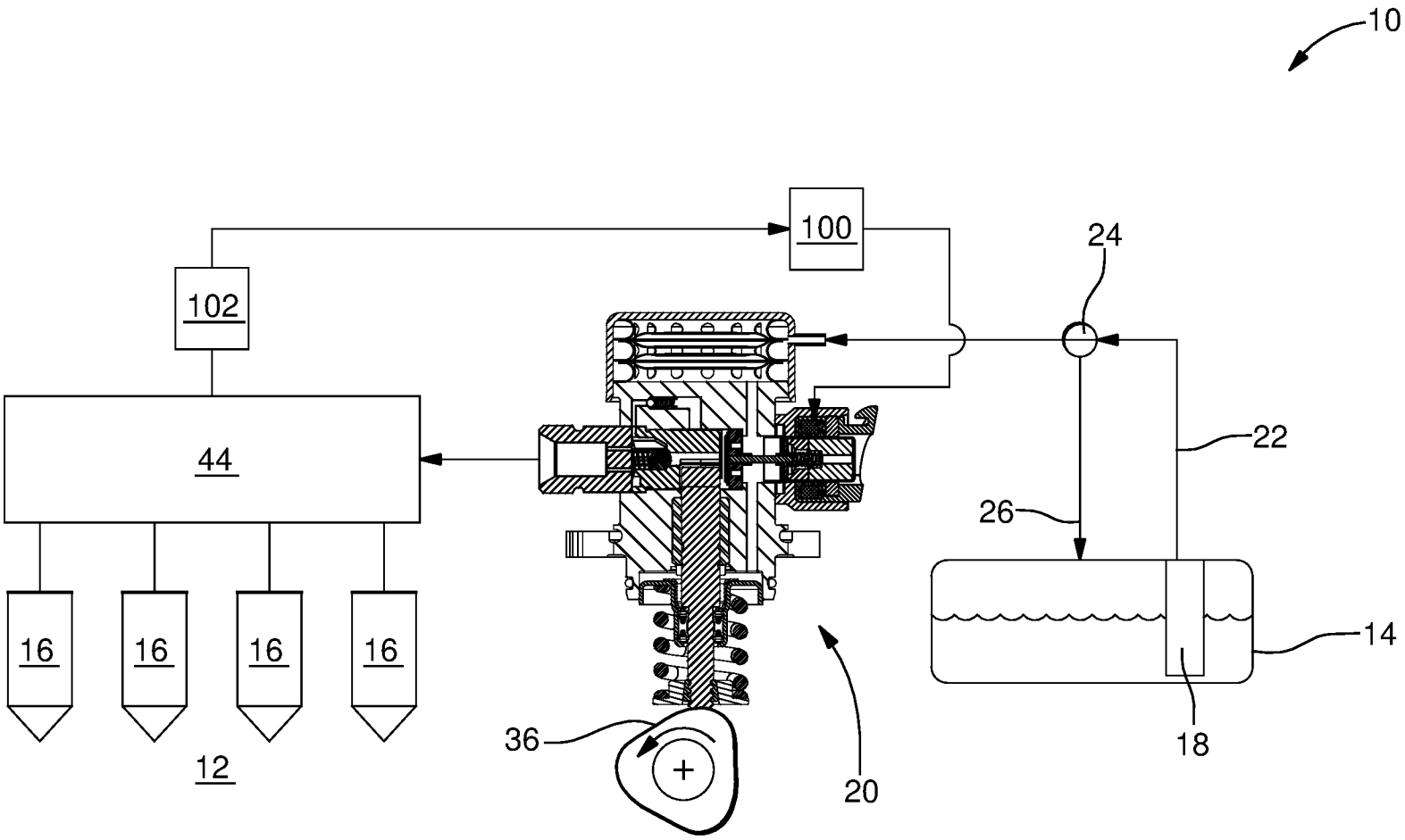
FIG. 1 is a schematic view of a fuel system including a fuel pump in accordance with the present invention.

In accordance with a preferred embodiment of this invention and referring initially to FIG. 1, a fuel system 10 for an internal combustion engine 12 is shown in schematic form. Fuel system 10 generally includes a fuel tank 14 which holds a volume of fuel to be supplied to internal combustion engine 12 for operation thereof; a plurality of fuel injectors 16 which inject fuel directly into respective combustion chambers (not shown) of internal combustion engine 12; a low-pressure fuel pump 18; and a high-pressure fuel pump 20 where the low-pressure fuel pump 18 draws fuel from fuel tank 14 and elevates the pressure of the fuel for delivery to high-pressure fuel pump 20 where the high-pressure fuel pump 20 further elevates the pressure of the fuel for delivery to fuel injectors 16. By way of non-limiting example only, low-pressure fuel pump 18 may elevate the pressure of the fuel to about 500 kPa or less and high-pressure fuel pump 20 may elevate the pressure of the fuel to above about 14 MPa and may be about 35 MPa depending on the operational needs of internal combustion engine 12. While four fuel injectors 16 have been illustrated, it should be understood that a lesser or greater number of fuel injectors 16 may be provided.

As shown, low-pressure fuel pump 18 may be provided within fuel tank 14, however low-pressure fuel pump 18 may alternatively be provided outside of fuel tank 14. Low-pressure fuel pump 18 may be an electric fuel pump as are well known to a practitioner of ordinary skill in the art. A low-pressure fuel supply passage 22 provides fluid communication from low-pressure fuel pump 18 to high-pressure fuel pump 20. A fuel pressure regulator 24 may be provided such that fuel pressure regulator 24 maintains a substantially uniform pressure within low-pressure fuel supply passage 22 by returning a portion of the fuel supplied by low-pressure fuel pump 18 to fuel tank 14 through a fuel return passage 26. While fuel pressure regulator 24 has been illustrated in low-pressure fuel supply passage 22 outside of fuel tank 14, it should be understood that fuel pressure regulator 24 may be located within fuel tank 14 and may be integrated with low-pressure fuel pump 18.

Figure 2:
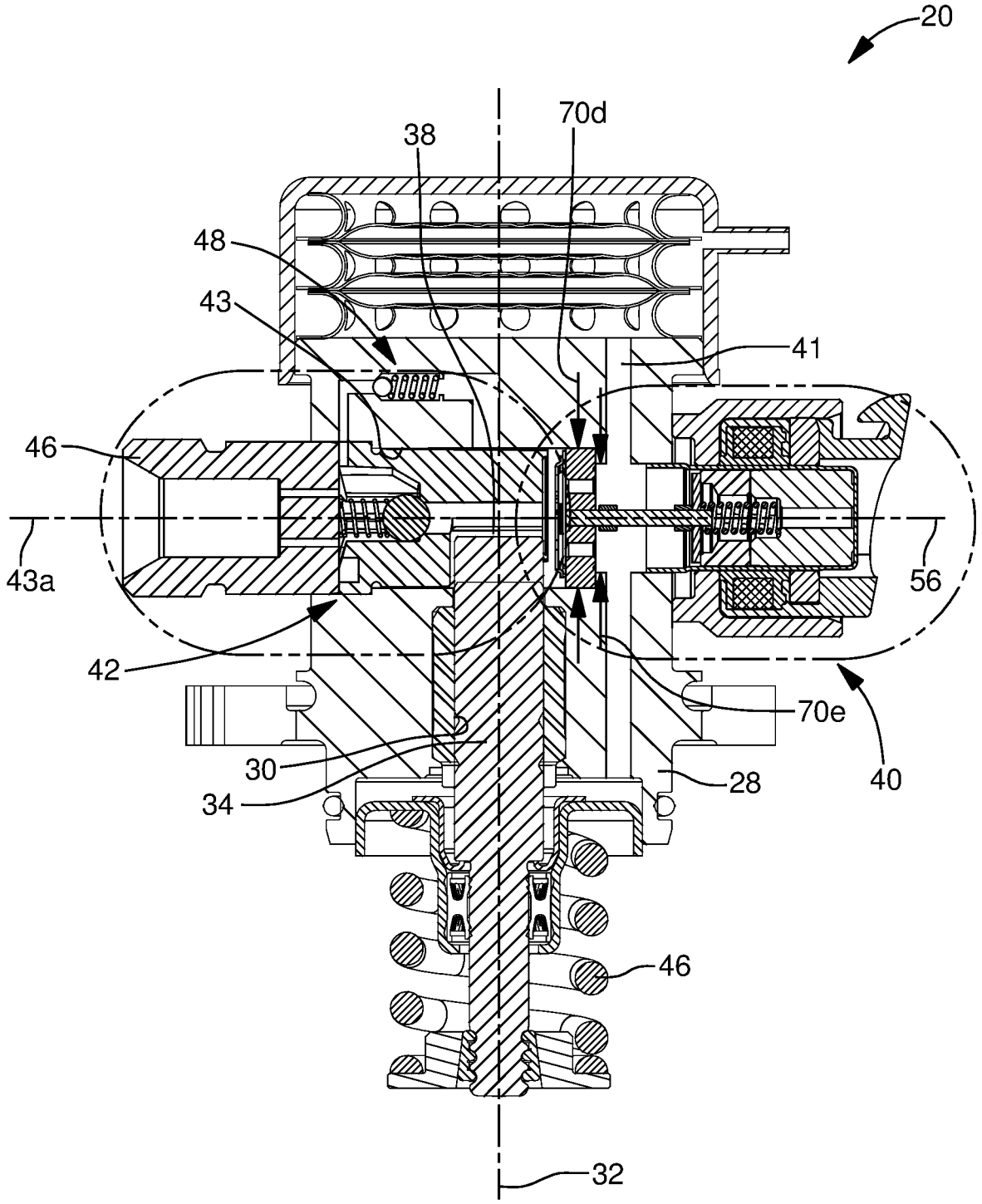
FIG. 2 is a cross-sectional view of the fuel pump of FIG. 1.
Figure 3:
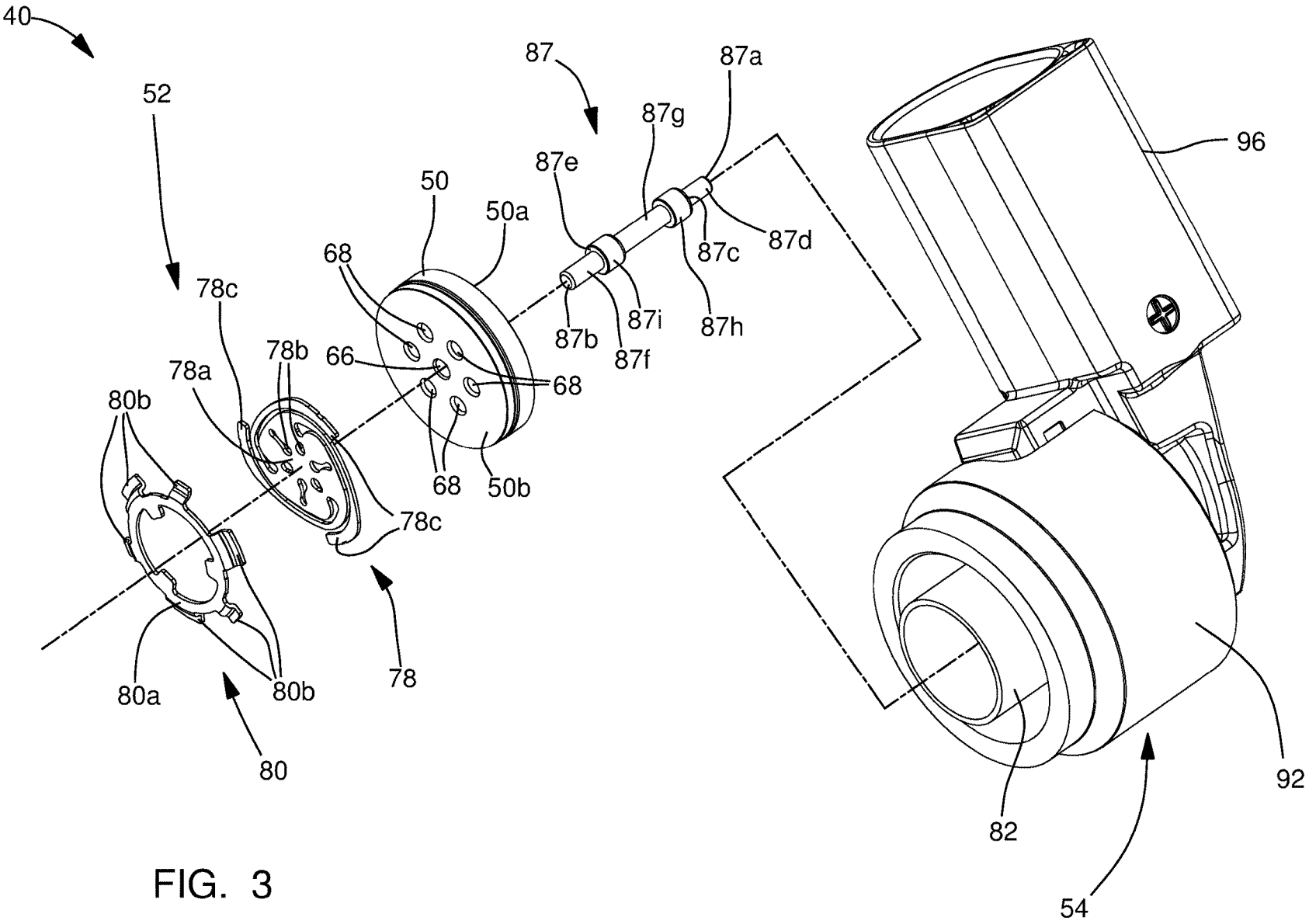
FIG. 3 is an exploded isometric view of an inlet valve assembly of the fuel pump of FIGS. 1 and 2.

Now with additional reference to FIG. 2, high-pressure fuel pump 20 includes a fuel pump housing 28 which includes a plunger bore 30 which extends along, and is centered about, a plunger bore axis 32. As shown, plunger bore 30 may be defined by a combination of an insert and directly by fuel pump housing 28 but may alternatively be formed only, and directly by, fuel pump housing 28. High-pressure fuel pump 20 also includes a pumping plunger 34 which is located within plunger bore 30 and reciprocates within plunger bore 30 along plunger bore axis 32 based on input from a rotating camshaft 36 of internal combustion engine 12 (shown only in FIG. 1). A pumping chamber 38 is defined within fuel pump housing 28. An inlet valve assembly 40 of high-pressure fuel pump 20 is located within a pump housing inlet passage 41 of fuel pump housing 28 and selectively allows fuel from low-pressure fuel pump 18 to enter pumping chamber 38 while an outlet valve assembly 42 is located within an outlet valve bore 43 of fuel pump housing 28 and selectively allows fuel to be communicated from pumping chamber 38 to fuel injectors 16 via a fuel rail 44 to which each fuel injector 16 is in fluid communication. Outlet valve bore 43 is centered about, and extends along, an outlet valve bore axis 43*a*. In operation, reciprocation of pumping plunger 34 causes the volume of pumping chamber 38 to increase during an intake stroke of pumping plunger 34 (downward as oriented in FIG. 2) in which a plunger return spring 46 causes pumping plunger 34 to move downward, and conversely, the volume of pumping chamber 38 decreases during a compression stroke (upward as oriented in FIG. 2) in which camshaft 36 causes pumping plunger 34 to move upward against the force of plunger return spring 46. In this way, fuel is drawn into pumping chamber 38 during the intake stroke, and conversely, fuel is pressurized within pumping chamber 38 by pumping plunger 34 during the compression stroke, depending on the state of operation of inlet valve assembly 40 as will be described in greater detail later, and discharged through outlet valve assembly 42 under pressure to fuel rail 44 and fuel injectors 16. For clarity, pumping plunger 34 is shown in phantom lines in FIG. 2 to represent the intake stroke at a bottom dead center position (volume of pumping chamber 38 is maximized) and pumping plunger 34 is shown in solid lines in FIG. 2 to represent the compression stroke at a top dead center position (volume of pumping chamber 38 is minimized) such that pumping plunger 34 reciprocates between the bottom dead center position and the top dead center position. High-pressure fuel pump 20 also includes a pressure relief valve assembly 48 which is arranged downstream of outlet valve assembly 42 in order to provide a fluid path back to pumping chamber 38 if the pressure downstream of outlet valve assembly 42 reaches a predetermined limit which may pose an unsafe operating condition if left unmitigated.

Figure 8:
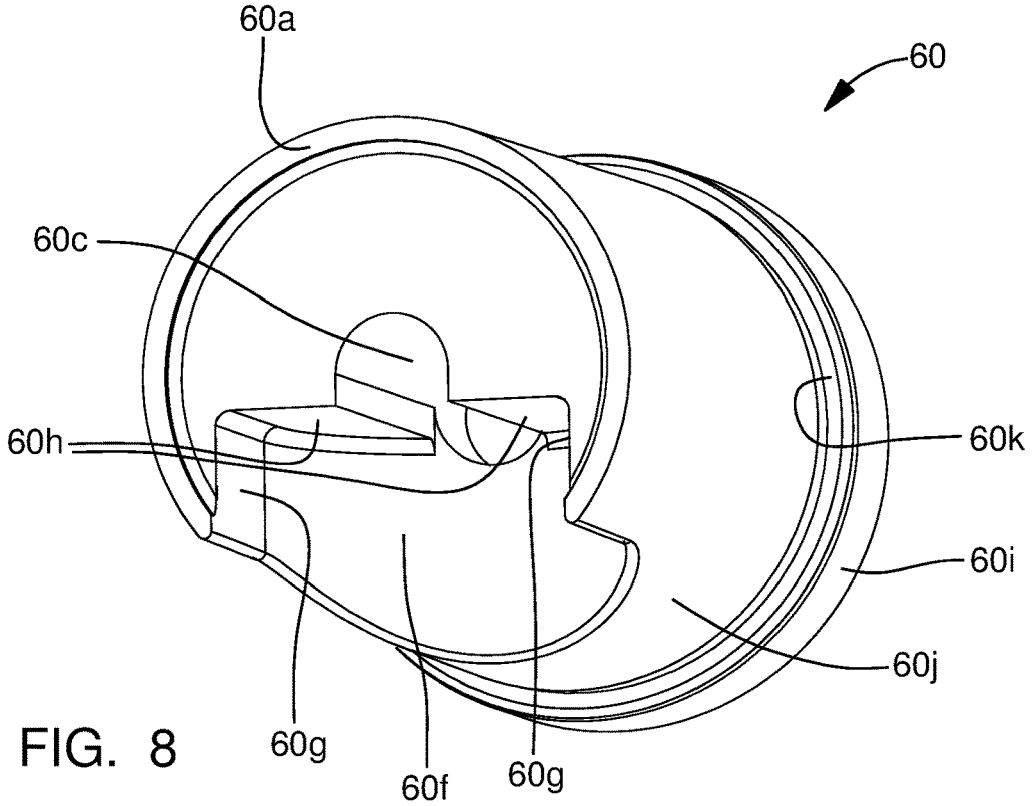
FIGS. 8 and 9 are isometric views of an outlet valve seat of the outlet valve assembly shown from two different perspectives.
Figure 9:
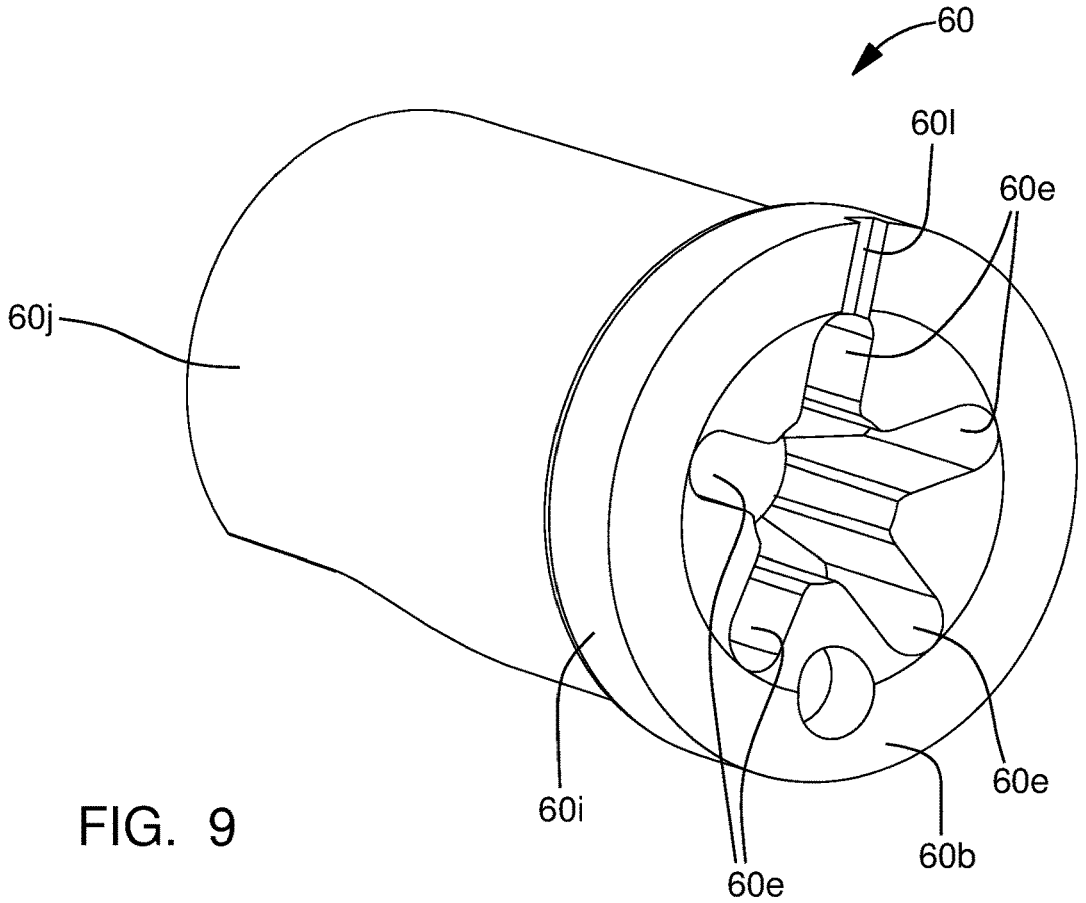

Outlet valve assembly 42 will now be discussed with continued reference to FIGS. 1 and 2 and additionally with particular reference to FIGS. 7-9. Outlet valve assembly 42 generally includes an outlet valve member 58, an outlet valve seat 60, and an outlet valve spring 62 where outlet valve spring 62 is held in compression between outlet valve member 58 and an outlet fitting 64 which is used to connect high-pressure fuel pump 20 to a fuel line between high-pressure fuel pump 20 and fuel rail 44. Outlet valve member 58, illustrated by way of non-limiting example only as a ball, is biased toward outlet valve seat 60 by outlet valve spring 62 where outlet valve spring 62 is selected to allow outlet valve member 58 to open when a predetermined pressure differential between pumping chamber 38 and fuel rail 44 is achieved. Outlet valve assembly 42 is oriented such that fuel is allowed to flow out of pumping chamber 38 through outlet valve assembly 42, however, fuel is not allowed to flow into pumping chamber 38 through outlet valve assembly 42.

Outlet valve seat 60 extends axially along outlet valve bore axis 43*a* from an outlet valve seat first end 60*a* which is within pumping chamber 38 to an outlet valve seat second end 60*b* which is outside of pumping chamber 38 and proximal to outlet fitting 64. Outlet valve seat 60 includes an outlet valve seat flow passage 60*c* extending therethrough which provides fluid communication fluid communication from pumping chamber 38 to outlet fitting 64 when outlet valve member 58 is unseated. Outlet valve seat flow passage 60*c* is stepped, thereby providing an outlet valve seating surface 60*d* upon which outlet valve member 58 seats (shown in solid lines in FIG. 7) to prevent fluid communication therethrough and from which outlet valve member 58 is unseated (shown in phantom lines in FIG. 7) to provide fluid communication therethrough. Downstream from outlet valve seating surface 60*d*, outlet valve seat flow passage 60*c* includes a plurality of flutes 60*e* which provide space for fuel to flow around outlet valve member 58 when outlet valve member 58 is spaced apart from outlet valve seating surface 60*d* while allowing outlet valve member 58 to be guided axially by the material between flutes 60*e*.

Figure 7:
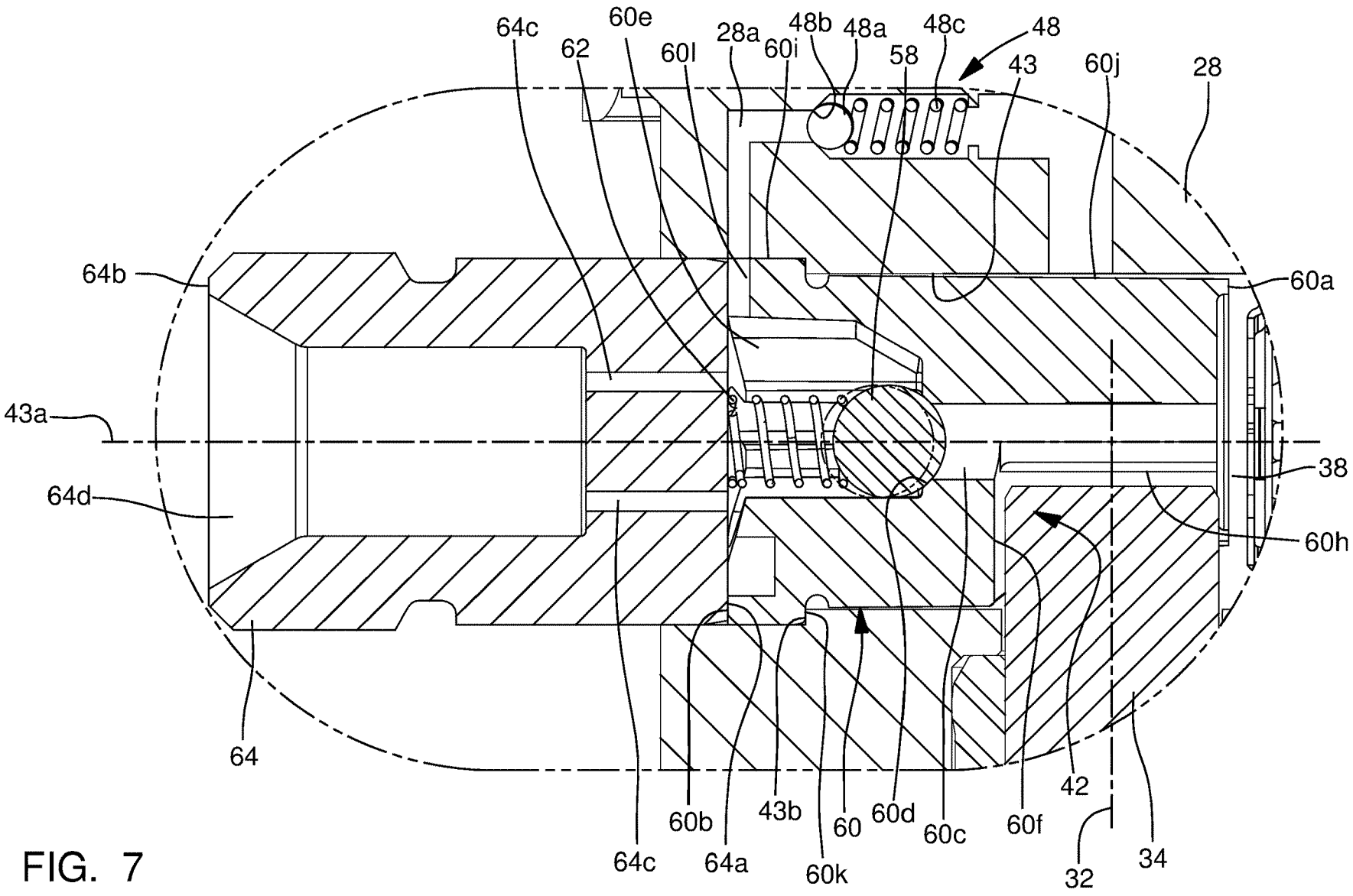
FIG. 7 is an enlargement of a portion of FIG. 2 showing an outlet valve assembly.

A first portion of outlet valve seat 60 is aligned with pumping plunger 34 in a direction parallel to plunger bore axis 32 which can be most easily seen in FIG. 7 while a second portion of outlet valve seat 60 is not aligned with pumping plunger 34 in a direction parallel to plunger bore axis 32. In order to provide space for pumping plunger 34 to reciprocate, outlet valve seat 60 includes an outlet valve seat slot 60*f* which extends radially thereinto and intersects with outlet valve seat flow passage 60*c*. As illustrated herein, outlet valve seat slot 60*f* may extend axially to outlet valve seat first end 60*a* such that outlet valve seat 60 includes outlet valve seat slot sidewalls 60*g* which face toward each other, and may be parallel to each other as shown and also parallel to plunger bore axis 32. Consequently a portion of pumping plunger 34 is located within outlet valve seat slot 60*f* at least when pumping plunger 34 is in the top dead center position and may be located within outlet valve seat slot 60*f* for the entire stroke between the bottom dead center position and the top dead center position. Outlet valve seat slot 60*f* is delimited in a direction parallel to plunger bore axis 32 by an outlet valve seat slot top wall 60*h* which is traverse to plunger bore axis 32 and which is preferably perpendicular to plunger bore axis 32. Furthermore, outlet valve seat slot top wall 60*h* is bifurcated by outlet valve seat flow passage 60*c*.

An outer periphery of outlet valve seat 60 may be stepped as shown, thereby having an outlet valve seat larger diameter section 60*i* which is proximal to outlet fitting 64, an outlet valve seat smaller diameter section 60*j* which is distal from outlet fitting 64, and an outlet valve seat shoulder 60*k* where outlet valve seat larger diameter section 60*i* meets outlet valve seat smaller diameter section 60*j*. Outlet valve bore 43 is also stepped, thereby forming an outlet valve bore shoulder 43*b* such that outlet valve seat 60 is inserted into outlet valve bore 43 until outlet valve seat shoulder 60*k* abuts outlet valve bore shoulder 43*b*. Furthermore, outlet valve seat larger diameter section 60*i* may engage outlet valve bore 43 in an interference fit, thereby providing sealing and preventing fuel from passing between the interface of outlet valve seat 60 and outlet valve bore 43.

In order to provide a path to pressure relief valve assembly 48, outlet valve seat 60 may include an outlet valve seat pressure relief passage 601 extending axially into outlet valve seat second end 60*b*. As illustrated in the figures, outlet valve seat pressure relief passage 601 may extend radially outward from one of the plurality of flutes 60*e* to the outer periphery of outlet valve seat larger diameter section 60*i*.

Outlet fitting 64 extends axially along outlet valve bore axis 43*a* from an outlet fitting first end 64*a* which is fixed within outlet valve bore 43 to an outlet fitting second end 64*b* which is outside of outlet valve bore 43. Outlet fitting first end 64*a* may be fixed within outlet valve bore 43, by way of non-limiting example only, by one or more of interference fit and welding, thereby providing a fluid tight interface between outlet fitting 64 and outlet valve bore 43. Outlet fitting 64 has a plurality of outlet fitting initial flow passages 64*c* which extend into outlet fitting 64 from outlet fitting first end 64*a* such that outlet fitting initial flow passages 64*c* are arranged to be eccentric to outlet valve bore axis 43*a*, thereby allowing outlet valve spring 62 to be grounded to a central portion of outlet fitting 64 at outlet fitting first end 64*a*. Outlet fitting initial flow passages 64*c* open into an outlet fitting final flow passage 64*d* which is centered about outlet valve bore axis 43*a* and extends to outlet fitting second end 64*b*, thereby providing fluid communication out of outlet fitting 64.

Pressure relief valve assembly 48 generally includes a pressure relief valve member 48*a*, a pressure relief valve seat 48*b*, and a pressure relief valve spring 48*c* where pressure relief valve seat 48*b* may be formed in a fuel pump housing pressure relief passage 28*a* of fuel pump housing 28. Fuel pump housing pressure relief passage 28*a* initiates at a radial location of outlet valve bore 43 that is aligned with outlet valve seat pressure relief passage 601 and terminates in pumping chamber 38 where a small gap is formed between outlet valve seat 60 and fuel pump housing 28. Pressure relief valve member 48*a*, illustrated by way of non-limiting example only as a ball, is biased toward pressure relief valve seat 48*b* by pressure relief valve spring 48*c* where pressure relief valve spring 48*c* is selected to allow pressure relief valve member 48*a* to open when a predetermined pressure differential between pumping chamber 38 and fuel rail 44 is achieved. Pressure relief valve assembly 48 is oriented such that fuel is allowed to flow into pumping chamber 38 through pressure relief valve assembly 48, however, fuel is not allowed to flow out of pumping chamber 38 through pressure relief valve assembly 48.

Inlet valve assembly 40 will now be described with continued reference to FIGS. 1 and 2 and additionally with particular reference to FIGS. 3-6. Inlet valve assembly 40 includes an inlet valve seat 50, an inlet check valve 52, and a solenoid assembly 54. The various elements of inlet valve assembly 40 will be described in greater detail in the paragraphs that follow.

Inlet valve seat 50 is centered about, and extends along, an inlet valve bore axis 56 such that inlet valve seat 50 extends from an inlet valve seat first end 50*a* to an inlet valve seat second end 50*b* where inlet valve seat first end 50*a* is distal from pumping chamber 38 and inlet valve seat second end 50*b* is proximal to pumping chamber 38. An inlet valve seat central passage 66 extends through inlet valve seat 50 such that inlet valve seat central passage 66 connects inlet valve seat first end 50*a* with inlet valve seat second end 50*b* and such that inlet valve seat central passage 66 is centered about, and extends along, inlet valve bore axis 56. A plurality of inlet valve seat flow passages 68 is provided in inlet valve seat 50 such that each inlet valve seat flow passage 68 extends through inlet valve seat 50 and such that each inlet valve seat flow passage 68 connects inlet valve seat first end 50*a* with inlet valve seat second end 50*b*. Each inlet valve seat flow passage 68 is laterally offset from inlet valve seat central passage 66 and extends through inlet valve seat 50 in a direction parallel to inlet valve bore axis 56.

Inlet valve seat 50 is located within an inlet valve bore 70 of fuel pump housing 28 such that inlet valve bore 70 is located between pump housing inlet passage 41 and pumping chamber 38 and such that inlet valve bore 70 extends along, and is centered about inlet valve bore axis 56. Inlet valve bore 70 is stepped such that inlet valve bore 70 includes a shoulder 70*a* which is traverse to inlet valve bore axis 56. Shoulder 70*a* faces toward pumping chamber 38. Inlet valve bore 70 includes an inlet valve bore first portion 70*b* which is proximal to pumping chamber 38 and also includes an inlet valve bore second portion 70*c* which is distal from pumping chamber 38. Inlet valve bore first portion 70*b* has a first diameter 70*d* while inlet valve second portion has a second diameter 70*e* which is less than first diameter 70*d*, and in this way, the difference between first diameter 70*d* and second diameter 70*e* forms shoulder 70*a* such that shoulder 70*a* joins inlet valve bore first portion 70*b* and inlet valve bore second portion 70*c*. Inlet valve seat 50, and more particularly inlet valve seat first end 50*a*, abuts shoulder 70*a* such that inlet valve seat 50, due to the orientation of shoulder 70*a* being toward pumping chamber 38, is urged toward shoulder 70*a* when pressure is generated within pumping chamber 38. Inlet valve seat 50 is fixed within inlet valve bore first portion 70*b* by interference fit which also provides sealing to prevent fuel from passing between the interface between the outer periphery of inlet valve seat 50 and the inner periphery of inlet valve bore first portion 70*b*. Consequently, while inlet valve seat 50 may be fixed within inlet valve bore 70, by way of non-limiting example only, by an interference fit, the interference fit is not relied upon to resist the forces generated during the pumping stroke. Instead, shoulder 70*a*, which is formed by the geometry of fuel pump housing 28, provides the support necessary to hold the axial position of inlet valve seat 50 and resist the pressure generated within pumping chamber 38, unlike the prior art which relies on one or more of interference fit, threaded connections, threaded fasteners, and welding to provide retention and resist the pressure generated within the pumping chamber 38.

Due to the stepped nature of inlet valve bore 70 with shoulder 70*a* facing toward pumping chamber 38, inlet valve seat 50 must be installed from the direction of pumping chamber 38. In order to allow installation of inlet valve seat 50 from the direction of pumping chamber 38, outlet valve bore 43 is sized to allow passage of inlet valve seat 50 therethrough. In other words, the smallest portion of outlet valve bore 43 is greater than or equal to the largest portion of inlet valve seat 50. As illustrated in the figures, outlet valve bore axis 43*a* may preferably be coincident with inlet valve bore axis 56 such that outlet valve bore 43 extends from pumping chamber 38 in a diametrically opposed relationship to inlet valve bore 70. In this way, prior to assembly of outlet valve assembly 42 into outlet valve bore 43, inlet valve seat 50 can be inserted through outlet valve bore 43 and pressed into inlet valve bore 70.

Inlet check valve 52 includes an inlet valve member 78 and a travel limiter 80. Inlet check valve 52 is arranged at inlet valve seat second end 50*b* such that inlet valve member 78 is moved between a seated position which blocks inlet valve seat flow passages 68 (shown in FIG. 5) and an open position which unblocks inlet valve seat flow passages 68 (shown in FIGS. 4 and 6) as will be described in greater detail later. Inlet valve member 78 includes an inlet valve member central portion 78*a* which is a flat plate with inlet valve member passages 78*b* extending therethrough where it is noted that only select inlet valve member passages 78*b* have been labeled in FIG. 3 for clarity. Inlet valve member passages 78*b* are arranged through inlet valve member central portion 78*a* such that inlet valve member passages 78*b* are not axially aligned with inlet valve seat flow passages 68. A plurality of inlet valve member legs 78*c* extend from inlet valve member central portion 78*a* such that inlet valve member legs 78*c* are resilient and compliant. Free ends of inlet valve member legs 78*c* are fixed to inlet valve seat second end 50*b*, for example, by welding. Consequently, when the pressure differential between pump housing inlet passage 41 and pumping chamber 38 is sufficiently high, inlet valve member central portion 78*a* is allowed to unseat from inlet valve seat second end 50*b* due to elastic deformation of inlet valve member legs 78*c*, thereby opening inlet valve seat flow passages 68. Travel limiter 80 includes a travel limiter ring 80*a* which is axially spaced apart from inlet valve seat second end 50*b* to provide the allowable amount of displacement of inlet valve member 78. Travel limiter 80 also includes a plurality of travel limiter legs 80*b* which provide the axial spacing between travel limiter ring 80*a* and inlet valve seat second end 50*b*. Travel limiter legs 80*b* are integrally formed with travel limiter ring 80*a* and are fixed to inlet valve seat second end 50*b*, for example by welding.

Solenoid assembly 54 includes an inner housing 82, a pole piece 84 located within inner housing 82, an armature 85 located within inner housing 82, a return spring 86 which biases armature 83 away from pole piece 84, a control rod 87, a spool 88, a coil 90, an overmold 92, and an outer housing 94. The various elements of solenoid assembly 54 will be described in greater detail in the paragraphs that follow.

Inner housing 82 is hollow and is centered about, and extends along, inlet valve bore axis 56. The outer periphery of inner housing 82 engages the inner periphery of a solenoid bore 95 of fuel pump housing 28 where solenoid bore 95 is centered about, and extends along inlet valve bore axis 56. Inner housing 82 is welded to fuel pump housing 28, thereby fixing solenoid assembly 54 to fuel pump housing 28.

Pole piece 84 is made of a magnetically permeable material and is received within inner housing 82 in fixed relationship to inner housing 82, for example by interference fit or welding, such that pole piece 84 is centered about, and extends along, inlet valve bore axis 56. A pole piece first end 84*a* of pole piece 84 includes a pole piece spring pocket 84*b* extending thereinto from pole piece first end 84*a* to a pole piece spring pocket bottom surface 84*c* such that pole piece spring pocket 84*b* may be cylindrical and centered about inlet valve bore axis 56 and such that a portion of return spring 86 is located within pole piece spring pocket 84*b* in abutment with pole piece spring pocket bottom surface 84*c*.

Armature 85 is made of a material which is attracted by a magnet and is received within inner housing 82 in a slidable relationship to inner housing 82 along inlet valve bore axis 56 such that armature 85 is centered about, and extends along, inlet valve bore axis 56. Armature 85 may be of two-piece construction as shown which includes an armature first portion 85*a* which is proximal to pole piece 84 and an armature second portion 85*b* which is fixed to armature first portion 85*a*, for example, by welding or mechanical fasteners and which is distal from pole piece 84. Armature first portion 85*a* includes an armature spring bore 85*c* extending thereinto from an armature first end 85*d* which is proximal to pole piece 84 and which is centered about, and extends along, inlet valve bore axis 56. A portion of return spring 86 is located within armature spring bore 85*c* and abuts against armature second portion 85*b* such that return spring 86 is held in compression between armature second portion 85*b* and pole piece spring pocket bottom surface 84*c*, thereby biasing armature 85 in a direction away from pole piece 84. Armature second portion 85*b* includes an armature control rod bore 85*e* extending axially therethrough such that armature control rod bore 85*e* is centered about, and extends along, inlet valve bore axis 56.

Control rod 87 extends from a control rod first end 87*a* which is proximal to armature 85 to a control rod second end 87*b* which is proximal to inlet valve member 78 such that control rod 87 is centered about, and extends along, inlet valve bore axis 56. Control rod 87 includes a control rod first shoulder 87*c* which is annular in shape and faces toward armature 85, and as shown, is transverse to inlet valve bore axis 56. A control rod first surface 87*d* extends from control rod first end 87*a* to control rod first shoulder 87*c* such that control rod first surface 87*d* is located at least partially within armature control rod bore 85*e* in a close sliding interface which allows control rod first surface 87*d* to freely move axially, i.e. along inlet valve bore axis 56, within armature control rod bore 85*e* while preventing radial movement, i.e. transverse to inlet valve bore axis 56, of control rod first surface 87*d* within armature control rod bore 85*e*. It is important to note that the close sliding interface between control rod first surface 87*d* and armature control rod bore 85*e* allows control rod 87 to move along inlet valve bore axis 56 independently of armature 85. Control rod first shoulder 87*c* limits the extent to which control rod first surface 87*d* is inserted into armature control rod bore 85*e* and control rod first shoulder 87*c* also provides a surface for armature 85 to react against in order to move control rod 87 toward inlet valve member 78 as will be described in greater detail later. Control rod 87 includes a control rod second shoulder 87*e* which is annular in shape and faces toward inlet valve seat 50, and as shown, is transverse to inlet valve bore axis 56. A control rod second surface 87*f* extends from control rod second end 87*b* to control rod second shoulder 87*e* such that control rod second surface 87*f* is located at least partially within inlet valve seat central passage 66 in a close sliding interface which allows control rod second surface 87*f* to freely move axially, i.e. along inlet valve bore axis 56, within inlet valve seat central passage 66 while preventing radial movement, i.e. transverse to inlet valve bore axis 56, of control rod second surface 87*f* within inlet valve seat central passage 66. In use, control rod second end 87*b* is used to interface with inlet check valve 52, and more particularly inlet valve member 78, as will be described in greater detail later.

As illustrated herein, control rod 87 may be of multi-piece construction which includes a control rod central portion 87*g*, a control rod first bushing 87*h* which is tubular and fixed to control rod central portion 87*g*, and a control rod second bushing 87*i* which is tubular and fixed to control rod central portion 87*g*. Control rod central portion 87*g* is preferably cylindrical and is centered about inlet valve bore axis 56 such that control rod central portion 87*g* extends from control rod first end 87*a* to control rod second end 87*b*. By way of non-limiting example only, control rod central portion 87*g* may be a roller bearing which is commercially available. Control rod first bushing 87*h* is preferably cylindrical on its outer periphery which is centered about, and extends along inlet valve bore axis 56 such that control rod first shoulder 87*c* is defined by one axial end of control rod first bushing 87*h*. Control rod first bushing 87*h* includes a control rod first bushing bore 87*j* extending axially therethrough such that control rod first bushing bore 87*j* is preferably cylindrical. In order to prevent relative movement between control rod first bushing 87*h* and control rod central portion 87*g*, control rod first bushing 87*h* is fixed to control rod central portion 87*g*, for example, by one or more of interference fit between control rod first bushing bore 87*j* and control rod central portion 87*g* and welding. Similarly, control rod second bushing 87*i* is preferably cylindrical on its outer periphery which is centered about, and extends along, inlet valve bore axis 56 such that control rod second shoulder 87*e* is defined by one axial end of control rod second bushing 87*i*. Control rod second bushing 87*i* includes a control rod second bushing bore 87*k* extending axially therethrough such that control rod second bushing bore 87*k* is preferably cylindrical. In order to prevent relative movement between control rod second bushing 87*i* and control rod central portion 87*g*, control rod second bushing 87*i* is fixed to control rod central portion 87*g*, for example, by one or more of interference fit between control rod second bushing bore 87*k* and control rod central portion 87*g* and welding. By making control rod 87 a multi-piece component, control rod central portion 87*g* may be provided as a roller bearing which is commercially available in high volumes at low cost with surface finishes and tolerances which are important to the close sliding fit needed between control rod 87 and inlet valve seat central passage 66 and between control rod 87 and armature control rod bore 85*e*. In an alternative arrangement, control rod first bushing 87*h* and control rod second bushing 87*i* may be combined to be a single bushing which minimizes the number of components, but has the drawback of increasing mass. In a further alternative, control rod 87 may be formed as a single piece of material in a turning operation.

While control rod 87 has been illustrated herein as being decoupled from armature 85, i.e. control rod 87 is able to move independently of armature 85, it should be understood that control rod 87 may be rigidly fixed to armature 85 such that control rod 87 always moves together with armature 85.

Spool 88 is made of an electrically insulative material, for example plastic, and is centered about, and extends along, inlet valve bore axis 56 such that spool 88 circumferentially surrounds inner housing 82 in a close-fitting relationship. Coil 90 is a winding of electrically conductive wire which is wound about the outer periphery of spool 88 such that coil 90 circumferentially surrounds a portion of pole piece 84. Consequently, when coil 90 is energized with an electric current, armature 85 is magnetically attracted to, and moved toward, pole piece 84, and when coil 90 is not energized with an electric current, armature 85 is moved away from pole piece 84 by return spring 86. A more detailed description of operation will be provided later.

Outer housing 94 circumferentially surrounds inner housing 82, spool 88, and coil 90 such that spool 88 and coil 90 are located radially between inner housing 82 and outer housing 94. Overmold 92 is an electrically insulative material, for example plastic, which fills the void between spool 88/coil 90 and outer housing 94 such that overmold 92 extends axially from outer housing 94 to define an electrical connector 96 which includes terminals (not shown) that are connected to opposite ends of coil 90. Electrical connector 96 is configured to mate with a complementary electrical connector (not show) for supplying electric current to coil 90 in use. As shown, a coil washer 98 may be provided within outer housing 94 axially between coil 90 and overmold 92 in order to complete the magnetic circuit of solenoid assembly 54.

Figure 4:
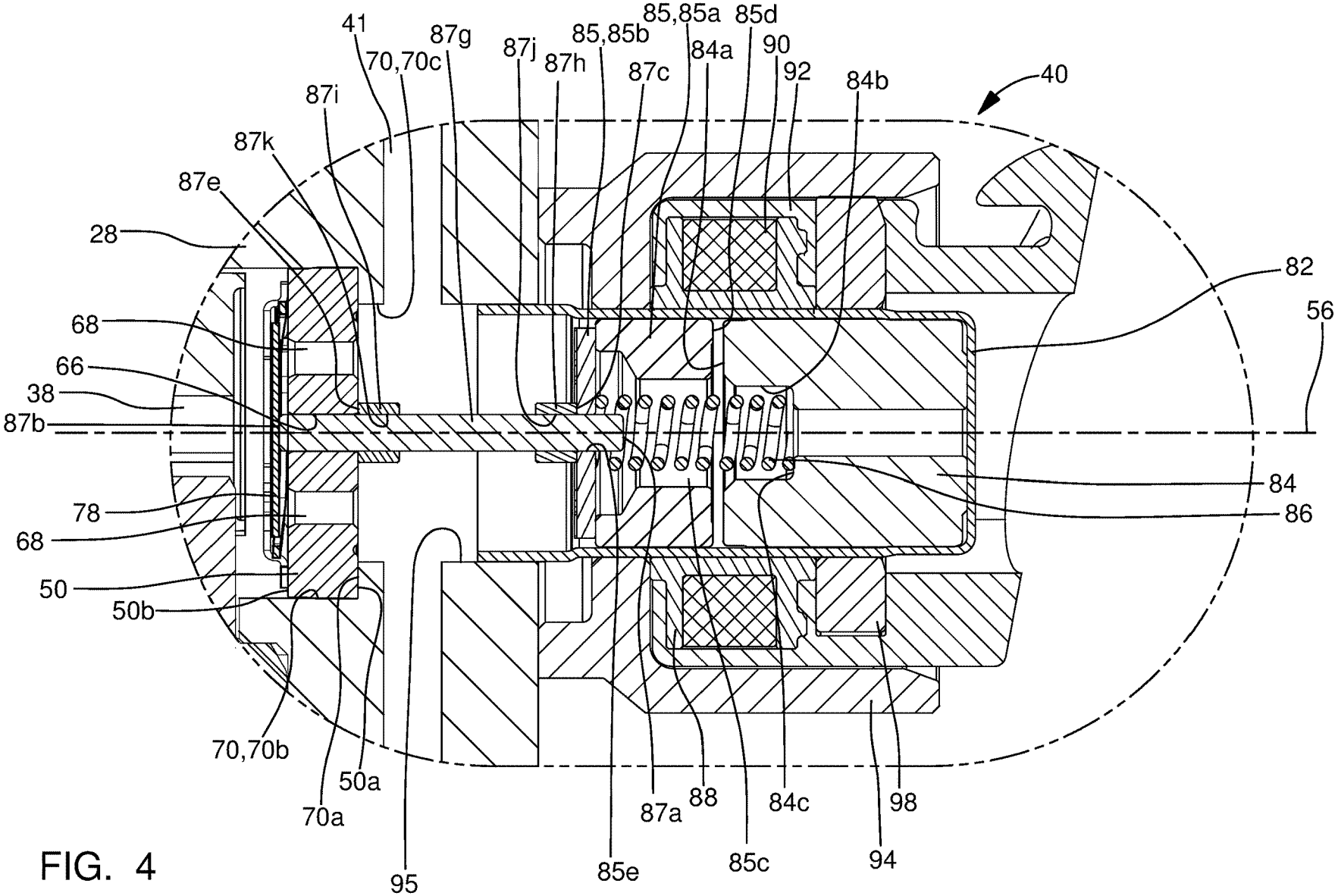
FIG. 4 is an enlargement of a portion of FIG. 2 showing the inlet valve assembly of the fuel pump in a first position.
Figure 6:
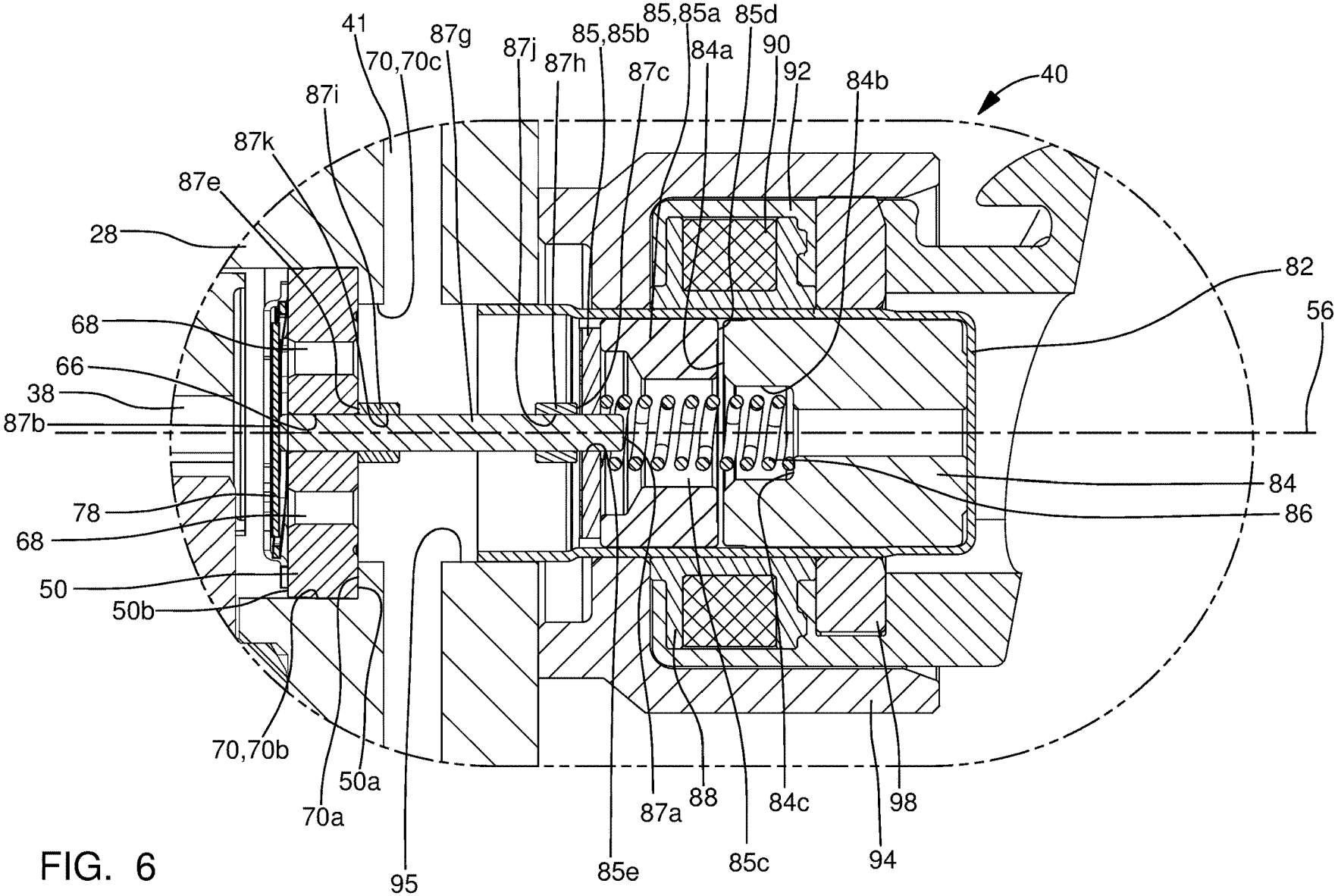
FIG. 6 is the view of FIGS. 4 and 5, now showing the inlet valve assembly in a transient position when moving from the position of FIG. 5 to the position of FIG. 4.

Operation of high-pressure fuel pump 20, and in particular, inlet valve assembly 40, will now be described with particular reference to FIG. 4 which shows armature 85 in a first position which results from no electric current being supplied to coil 90 of solenoid assembly 54. When no electric current is supplied to coil 90, return spring 86 urges armature 85 away from pole piece 84. As armature 85 is urged away from pole piece 84, armature second portion 85*b* comes into contact with control rod first shoulder 87*c* and control rod 87 is urged toward inlet valve member 78 until control rod second shoulder 87*e* abuts valve seat first end 54*a* which allows control rod second end 87*b* to protrude beyond inlet valve seat second end 50*b* such that control rod second end 87*b* moves inlet valve member 78 to, and holds inlet valve member 78 in, an unseated position which permits flow through inlet valve seat flow passages 68 and such that inlet valve seat flow passages 68 are in fluid communication with pumping chamber 38. However, it is important to note that armature 85 may not remain in contact with control rod first shoulder 87*c* for the entire duration of travel, thereby allowing control rod second shoulder 87*e* to abut inlet valve seat first end 50*a* before armature 85 again comes into contact with control rod first shoulder 87*c*. Consequently, two smaller, individual impacts may result which helps to minimize noise. To illustrate this phenomenon, FIG. 6 shows a transient position where control rod second shoulder 87*e* has impacted inlet valve seat first end 50*a*, however, armature 85 has not yet regained contact with control rod first shoulder 87*c*. Without being bound by theory, this may result from armature 85 impacting control rod first shoulder 87*c* and propelling control rod 87 ahead of armature 85. Holding open inlet valve member 78 open may be utilized to allow fuel to spill back toward pump housing inlet passage 41 during a portion of the compression stroke of pumping plunger 34 based on the mass of fuel that is needed to be delivered to fuel injectors 16, i.e. different operating conditions of internal combustion engine 12 require different fuel masses to be delivered to fuel injectors 16 for each pumping cycle of pumping plunger 34 and the mass of fuel delivered to fuel injectors 16 can be adjusted by allowing a portion of the fuel involved in a compression stroke to be spilled back to pump housing inlet passage 41. An electronic control unit 100 may be used to time the supply of electric current to coil 90 during the compression stroke, thereby varying the proportion of fuel from the compression stroke that is supplied to fuel injectors 16 and the proportion of fuel from the compression stroke that is spilled back to pump housing inlet passage 41. Electronic control unit 100 may receive input from a pressure sensor 102 which senses the pressure within fuel rail 44 in order to provide proper timing of the supply electric current to coil 90 in order to maintain a desired pressure in fuel rail 44 which may vary based on the commanded torque desired to be produced by internal combustion engine 12.

Figure 5:
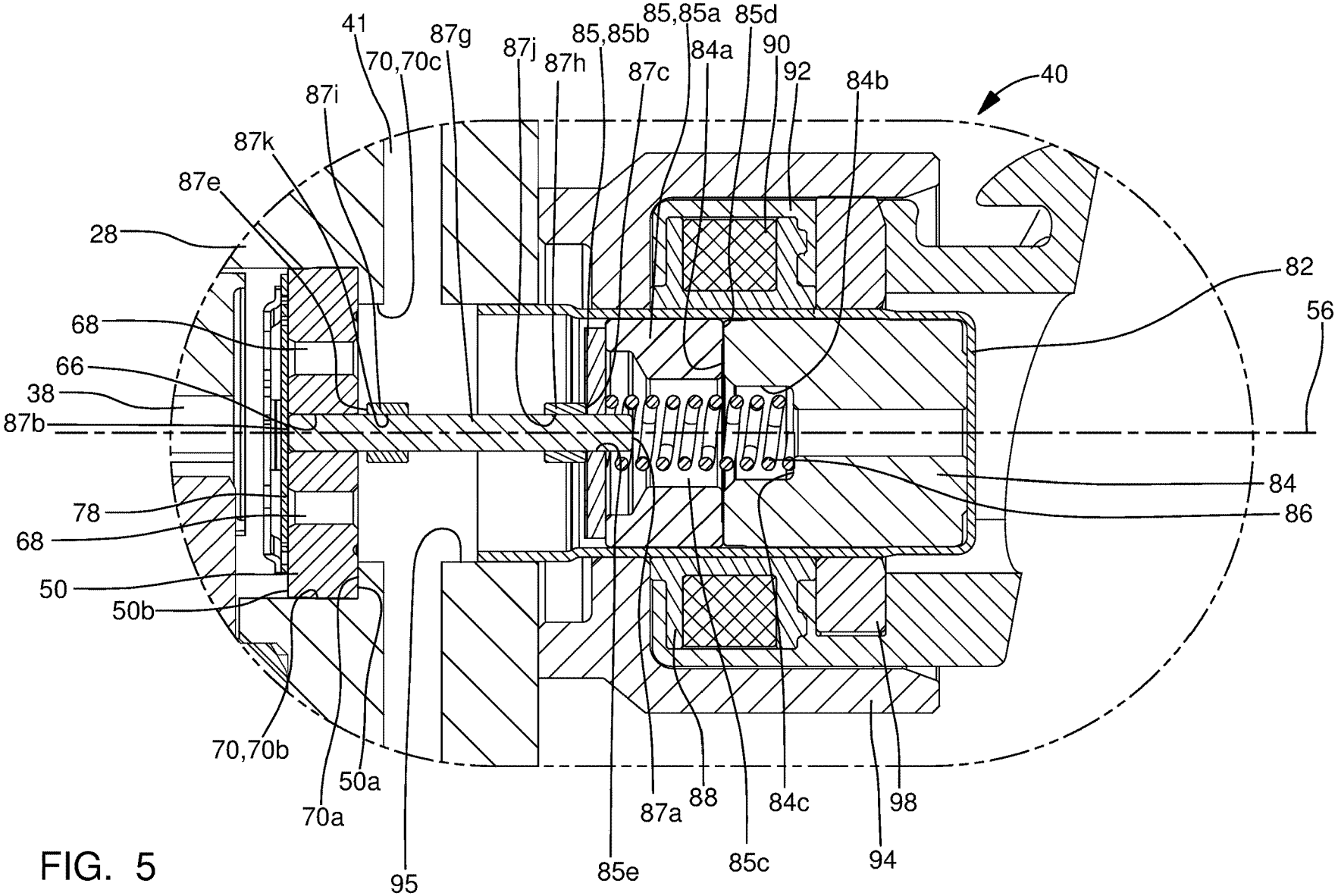
FIG. 5 is the view of FIG. 4, now showing the inlet valve assembly in a second position.

Now with particular reference to FIG. 5, armature 85 is shown in a second position which results from electric current being supplied to coil 90 of solenoid assembly 54. When electric current is supplied to coil 90, armature 85 is attracted to, and moves toward, pole piece 84 until armature first end 85*d* abuts pole piece first end 84*a*. When electric current is supplied to coil 90 during the compression stroke of pumping plunger 34, fuel pressure within pumping chamber 38 acts on inlet valve member 78, and since armature 85 is no longer acting upon control rod 87, inlet valve member 78 urges control rod 87 toward armature 85 until inlet valve member 78 blocks inlet valve seat flow passages 68. It should be noted that since control rod 87 and armature 85 are allowed to move independently of each other along inlet valve bore axis 56, armature 85 separates from control rod first shoulder 87*c*. As a result, an impact resulting only from the mass of armature 85 coming into abutment with pole piece 84 occurs. Furthermore, since this impact does not include the mass of control rod 87, a smaller sound intensity is produced compared to prior art inlet control valves. It should also be noted that the position of armature 85 illustrated in FIG. 5 does not require inlet valve member 78 to be in the seated position, but rather, the state of inlet valve member 78 is determined by the differential pressure across inlet valve member 78. In this way, inlet valve member 78 is opened during the intake stroke to allow fuel to flow into pumping chamber 38.

High-pressure fuel pump 20 with inlet valve seat 50 supported by shoulder 70*a* of fuel pump housing 28 as described herein allows the high cyclic load generated by the pressurization of fuel within pumping chamber 38 to be carried directly by fuel pump housing 28 rather than by secondary means such as interference fit, threaded connections, welding, and threaded fasteners as is currently used in the prior art. In this way, the number of components and processes is reduced, thereby reducing cost and providing a more robust connection. Furthermore, outlet valve seat 60 as described herein minimizes the dead volume of pumping chamber 38, thereby maximizing efficiency while still allowing inlet valve seat 50 to be installed through pumping chamber 38.

While this invention has been described in terms of preferred embodiments thereof, it is not intended to be so limited, but rather only to the extent set forth in the claims that follow.

I claim:

1. A fuel pump comprising:

a fuel pump housing with a pumping chamber defined therein, said fuel pump housing having an outlet valve bore, said outlet valve bore extending along, and being centered about, an outlet valve bore axis;

a pumping plunger which reciprocates within a plunger bore along a plunger bore axis which is traverse to said outlet valve bore axis such that an intake stroke of said pumping plunger increases volume of said pumping chamber and a compression stroke of said pumping plunger decreases volume of said pumping chamber; and an outlet valve assembly comprising:

an outlet valve seat with an outlet valve seat flow passage extending therethrough, wherein a first portion of said outlet valve seat is aligned with said pumping plunger in a direction parallel to said plunger bore axis and wherein a second portion of said outlet valve seat is not aligned with said pumping plunger in a direction parallel to said plunger bore axis; and an outlet valve member which is moveable between 1) an unseated position which provides fluid communication through said outlet valve seat flow passage and 2) a seated position which prevents fluid communication through said outlet valve seat flow passage.

2. A fuel pump as in claim 1, wherein said outlet valve seat extends along said outlet valve bore axis from an outlet valve seat first end which is within said pumping chamber to an outlet valve seat second end which is outside of said pumping chamber.

3. A fuel pump as in claim 2, wherein:

said outlet valve seat includes an outlet valve seat slot extending thereinto;

said pumping plunger reciprocates between a top dead center position in which volume of said pumping chamber is minimized to a bottom dead center position in which volume of said pumping chamber is maximized; and a portion of said pumping plunger is located within said outlet valve seat slot when said pumping plunger is in said top dead center position.

4. A fuel pump as in claim 3, wherein said outlet valve seat slot extends into said outlet valve seat from said outlet valve seat first end.

5. A fuel pump as in claim 3, wherein said outlet valve seat slot intersects with said outlet valve seat flow passage.

6. A fuel pump as in claim 3, wherein said outlet valve seat slot is delimited in a direction parallel to said plunger bore axis by an outlet valve seat slot top wall which is traverse to said plunger bore axis.

7. A fuel pump as in claim 6, wherein said outlet valve seat slot top wall is perpendicular to said plunger bore axis.

8. A fuel pump as in claim 6, wherein said outlet valve seat slot top wall is bifurcated by said outlet valve seat flow passage.

9. A fuel pump as in claim 6, wherein said outlet valve seat includes a pair of outlet valve seat sidewalls which face toward teach other.

10. A fuel pump as in claim 9, wherein said outlet valve seat sidewalls are parallel to each other and parallel to said plunger bore axis.

11. A fuel pump as in claim 1, wherein:

wherein said outlet valve seat extends along said outlet valve bore axis from an outlet valve seat first end which is within said pumping chamber to an outlet valve seat second end which is outside of said pumping chamber;

said fuel pump further comprises an outlet fitting which is down stream of said outlet valve seat;

an outlet valve seat pressure relief passage is formed axially between said outlet valve seat second end and said outlet fitting;

said fuel pump housing includes a fuel pump housing pressure relief passage which initiates at a radial location at a radial location of said outlet valve bore that is aligned with said outlet valve seat pressure relief passage and terminates in said pumping chamber; and said fuel pump includes a pressure relief valve assembly located in said fuel pump housing pressure relief passage such that said pressure relief valve assembly allows fuel to flow into said pumping chamber through said fuel pump housing pressure relief passage and such that said pressure relief valve assembly prevents fuel from flowing out of said pumping chamber through said fuel pump housing pressure relief passage.

12. A fuel pump as in claim 11, wherein said outlet valve seat pressure relief passage extends axially into said outlet valve seat second end.

13. A fuel pump as in claim 11, wherein said outlet valve assembly further comprises an outlet valve spring which is grounded against said outlet fitting and biases said outlet valve member toward said seated position.

* * * * *